US005445205A

United States Patent [19]

Hansen

[11] Patent Number: 5,445,205

[45] Date of Patent: Aug. 29, 1995

[54] VERTICAL BLIND ASSEMBLY

[76] Inventor: Don Hansen, 1703 E. Heritage Cir., Anaheim, Calif. 92804

[21] Appl. No.: 133,569

[22] Filed: Oct. 8, 1993

[51] Int. Cl.[6] ..... E06B 9/30

[52] U.S. Cl. ..... 160/168.1

[58] Field of Search ..... 160/168.1 V, 176.1 V, 160/173 V, 177 V, 178.1 V, 900

[56] References Cited

U.S. PATENT DOCUMENTS

| | | | |
|---|---|---|---|
| 2,759,534 | 8/1956 | Harju | 160/168.1 V |
| 4,267,875 | 5/1981 | Kuks | 160/168.1 X |
| 4,350,197 | 9/1982 | Haller | 160/176.1 X |
| 4,628,981 | 12/1986 | Ciriaci et al. | 160/176 R |
| 4,648,436 | 3/1987 | Oskam | 160/168.1 V |
| 4,736,784 | 4/1988 | Boloix | 160/168.1 V |
| 4,754,796 | 7/1988 | Ciriaci | 160/173 V |
| 4,834,163 | 5/1989 | Dickstein | 160/176.1 V |
| 4,928,744 | 5/1990 | Oskam | 160/177 V X |
| 5,067,544 | 11/1991 | Spohr et al. | 160/177 V |
| 5,289,863 | 3/1994 | Schon | 160/168.1 V |

*Primary Examiner*—David M. Purol
*Attorney, Agent, or Firm*—James G. O'Neill

[57] ABSTRACT

A vertical blind system includes a head casing having a track and open ends with interchangeable end caps held in the open ends and a plurality of suspended vertical blinds held vertically by a plurality of carriers movable along the track in the head casing between the end caps. Each carrier has an elongate, open sided, substantially rectangular hollow housing with a vertical blind holder rotatably secured therein, coacting with a worm gear rotatably also mounted therein adjacent to and in engagement with a further gear formed on the vertical blind holder. A rachet is formed interiorly of the worm gear, and a holding element for a pull cord is formed integrally with the housing and includes a resilient opening to allow quick and easy insertion of the pull cord into the holding element from outside of the head casing.

20 Claims, 4 Drawing Sheets

VERTICAL BLIND ASSEMBLY

BACKGROUND OF THE INVENTION

1. Field of the Invention

This invention relates generally to vertical blinds or louvers and more particularly to an improved vertical blind assembly having a plurality of vertical blinds suspended in a head casing, and which vertical blinds are both selectively positioned along the longitudinal axis of, and rotated in, in aligned relationship to each other, the head casing.

2. Description of Related Art

U.S. Pat. No. 4,628,981, provides a description of the prior art for vertical louver or blind assemblies, and a specific vertical blind assembly to overcome some of the deficiencies of the prior art. The description of the prior art and the relevant disclosure of U.S. Pat. No. 4,628,981 is incorporated herein, in its entirety, by this reference thereto. However, although U.S. Pat. No. 4,628,981 does solve certain of the problems which occur in such vertical blind assemblies, the need still exists for a simple, low-cost and easy to manufacture vertical blind assembly, having means for holding each vertical blind in, and moving such blinds, in a spaced relationship, along a track system which follows the longitudinal axis of a head casing, and which head casing includes interchangeable end caps so as to selectively rotatably support the individual vertical blinds therein, so that the blinds are oriented in substantially the same direction. Furthermore, there still exists the need in the art for a blind assembly which is easily modified, depending on where it is to be hung and how it is to open, and which assembly is easily serviced to thereby extend its life expectancy, while at the same time being relatively simple and comparatively low in cost to manufacture and assemble.

SUMMARY OF THE INVENTION

Accordingly, it is a general object of the present invention to provide an improved vertical blind assembly. It is a particular object of the present invention to provide an improved vertical blind assembly which is easy to manufacture, assemble and service. It is a still more particular object of the present invention to provide a vertical blind assembly having a plurality of vertical blinds which are inserted and held in place in an elongated head casing and which blinds may be selectively positioned along the longitudinal axis of the head casing, as well as rotated relative to the head casing by gear means including a rachet type adjusting means, so as to be substantially self aligning. It is yet another particular object of the present invention to provide an improved vertical blind assembly which utilizes readily interchangeable end caps for the head casing, and in which the pull cord for longitudinal movement of each blind in the head casing may be easily inserted into individual blind carriers, so that the assembly may be quickly assembled and readily adapted for use in any size or type of opening.

In accordance with one aspect of the present invention, there is provided a plurality of elongated vertical blinds, secured in the vertical position and supported from a track system in a head casing by individual carriers movable therein. The individual carriers are adapted to be moved transversely of the head casing and the suspended blinds rotated concurrently, relative to each carrier, by selective means in the individual blind carriers, which include ratchet means. Additionally, the present invention provides means in each of the blind carriers to allow for the simple and quick insertion therein of a pull cord for longitudinal movement of each of the carriers and its respective vertical blind, and end caps for the head casing which are readily and easily inserted, reversed and/or interchangeable with each other.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 1:
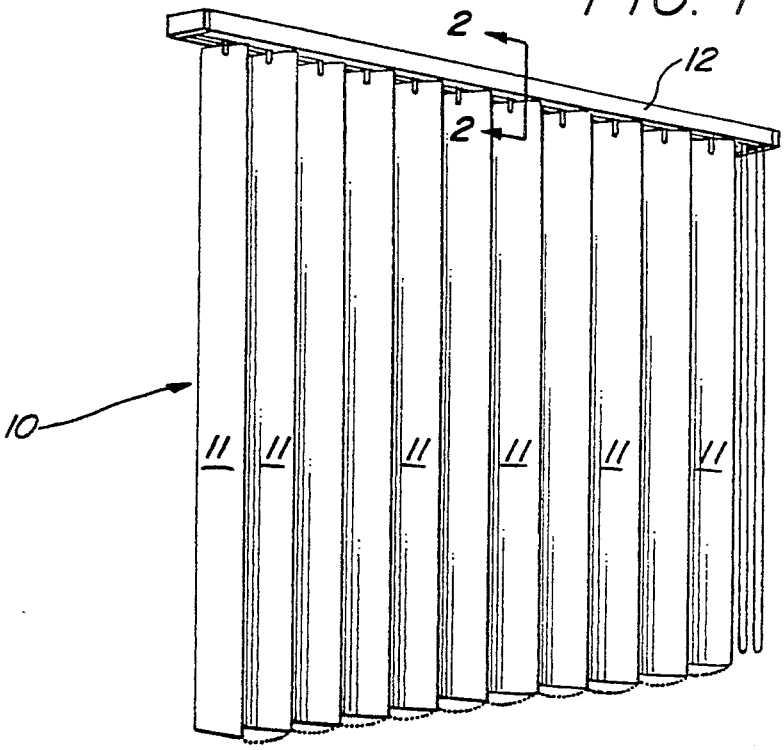
FIG. 1 is an isometric view of a vertical blind assembly of the present invention supporting a plurality of vertical blinds in overlapping relationship by carrier means in an elongated head casing.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved vertical blind assembly, identified generally at 10 in the drawings.

It is to be understood that the present invention is an improvement in and to the vertical blind assembly, including the blind carrier and the end caps of the head casing, disclosed in U.S. Pat. No. 4,628,980, discussed above.

FIG. 1 of the drawings illustrates the blind assembly 10 as having a plurality of separate, overlapping vertical blinds 11, movably held in an elongated head casing 12. Each vertical blind 11 is inserted and held in a resilient gripping or holding means 15, rotatably secured in a blind carrier means 14, as shown in FIG. 2, and described in more detail below.

Figure 2:
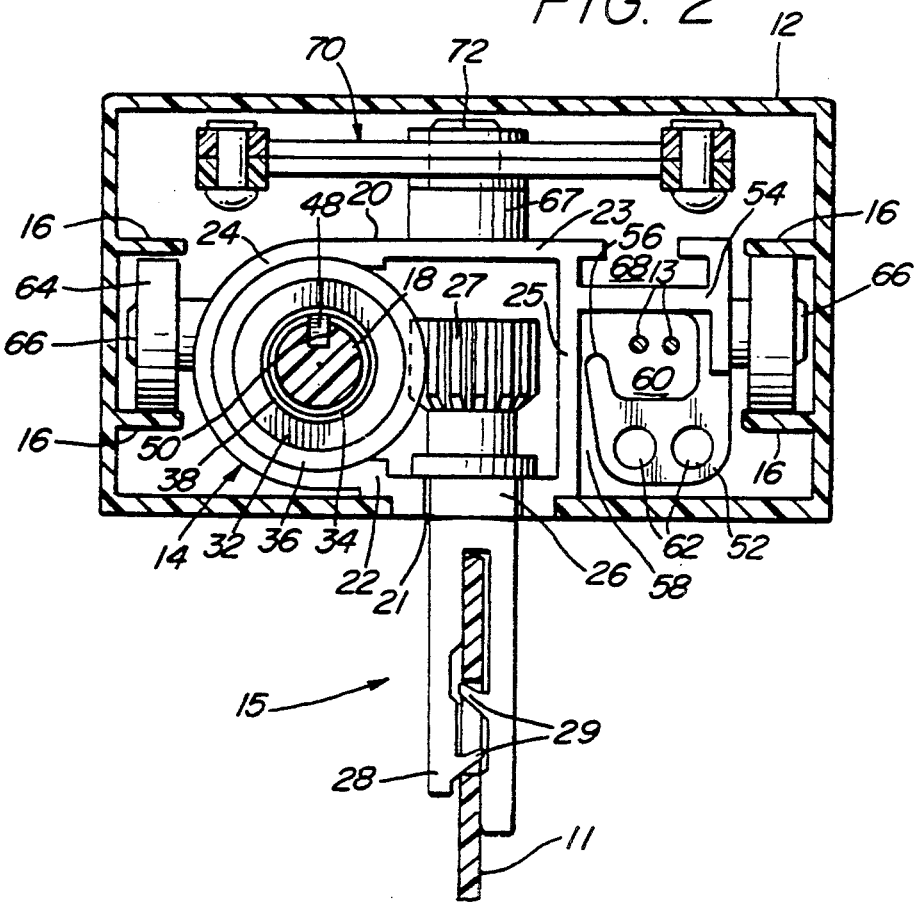
FIG. 2 is an enlarged sectional view taken along line 2—2 of FIG. 1, through the head casing and an individual blind carrier of the present invention.
Figure 3:
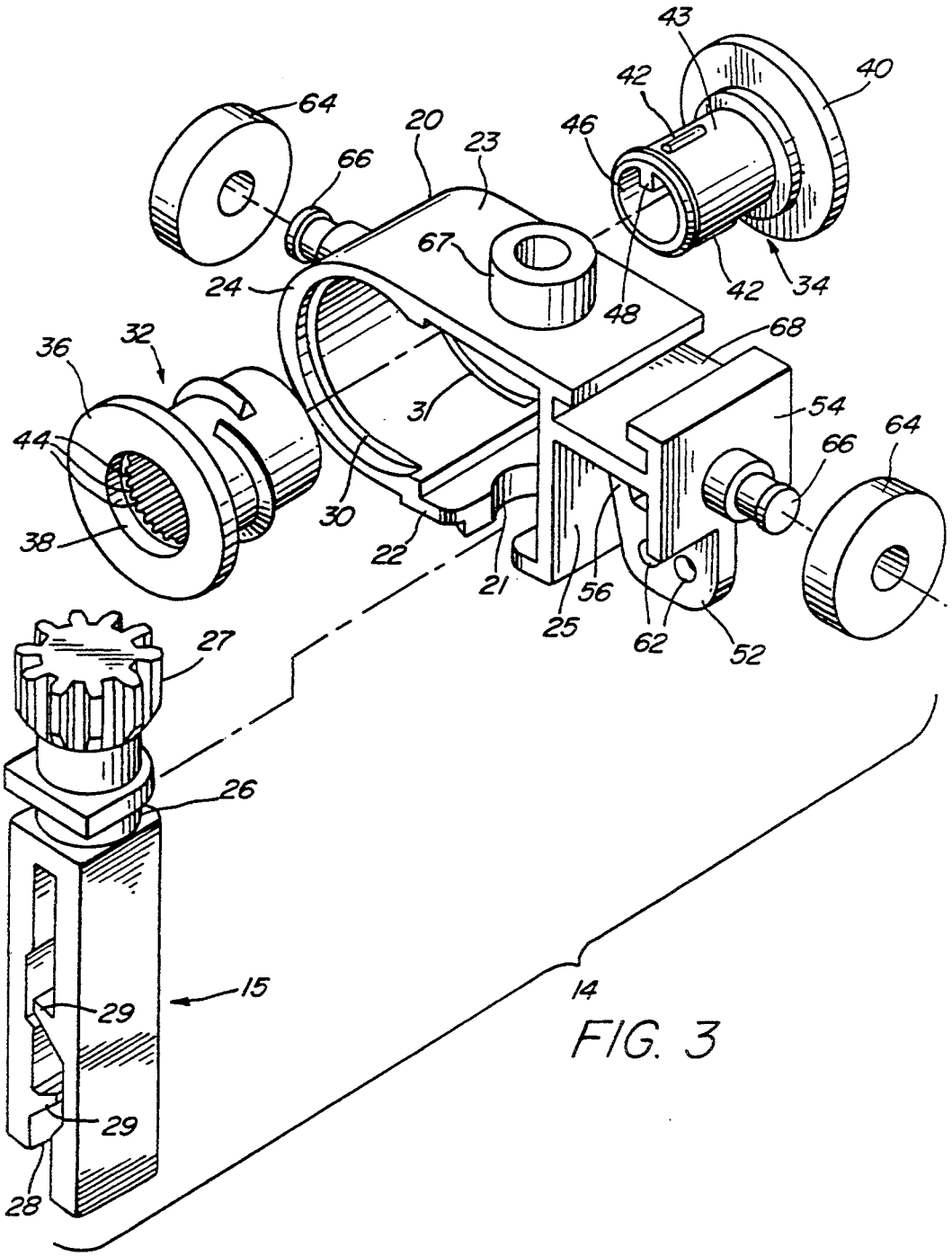
FIG. 3 is an exploded perspective view of an individual blind carrier of the present invention.

FIGS. 2 and 3 most clearly show the blind carrier 14, a plurality of which are movably mounted in a track system 16 formed in the elongated head casing 12 so as to enable the depending blinds 11 to be moved longitudinally along the head casing in track 16, by means of a continuous pull cord 13, in a manner known to those skilled in the art. Furthermore, each carrier means 14 includes further means which coact with a rotation means, such as a pull chain 17 (see FIGS. 5 and 7) and a positioning rod 18, to allow concurrent rotation of each blind by the positioning rod 18, as is explained more fully below.

Each carrier means 14 consists of an open sided unitary or integral housing 20 having a base 22, a top 23 and connecting end portions 24, 25. An aperture or opening 21 is formed in the base 22 for insertion therein of the blind holding means 15 so as to be held in a "snap fit" by a reduced diameter upper portion 26 thereof, for rotation in the housing. The blind holding means 15 further includes a gear element 27 fixed thereto adjacent one end, above the reduced diameter portion 26, so as to be within the housing 20 when holding means 15 is snap fit therein, and a resilient, bifurcated other or outer end portion 28 into which the blind 11 is inserted and held by a plurality of deformable, resilient detents, teeth, or the like 29. The end of the holding means 15, above the reduced diameter portion 26 within the housing 20 may be extended upwardly and held in the top wall or portion 23, to aid in guiding the holding means 15 in the housing.

End portion 24 of housing 20 is preferably formed integrally therewith and is substantially semicircular in cross section to form an internal opening of a selected size, with a pair of enlarged, partial annular areas 30, 31 formed adjacent the open sides of the housing. A worm gear 32, and a rachet carrier 34 are inserted into the housing 20, from opposite open sides and held together, as by being snap or press fit into each other, with raised annular flanges or lips 36, 40 extending into the enlarged, partial annular areas 30 and 31, for rotation therein, as discussed more fully below.

As shown in FIG. 2, a depending tubular portion 43 of rachet carrier 34 is inserted into and held in an interior opening 38 formed through worm gear 32, after the worm gear has been inserted into the housing 20 with the flange 36 in partial annular area 30. With the worm gear 32 and ratchet carrier 34 snap fit together in the housing 20, the annular lips 36 and 40 will allow the elements to rotate in the housing, but prevent these held together elements from being removed therefrom. The exterior surface of the tubular portion 43 of rachet carrier 34 includes one or more raised, resilient rachet elements 42 integrally formed thereto (shown enlarged in the drawing, for illustrative purposes only) for coaction with a plurality of resilient internal detents or teeth 44, formed integrally around the entire circumference of interior opening 38 of worm gear 32. Additionally, rachet carrier 34 includes a central opening 46 with a substantially rectangular key or tooth 48 formed integrally therein for coaction with an elongated slot 50 formed in positioning rod 18, when the positioning rod is inserted therethrough.

It, therefore, can be seen that rachet carrier 34 may slide along the positioning rod 18, with the rectangular tooth 48 in slot 50, and be rotated with the positioning rod 18, upon movement of the pull chain 17. In turn, the resilient rachet elements 42 of rachet carrier 34 will rotate the worm gear by means of the frictional engagement thereof with one or more internal detents or teeth 44, unless or until the worm gear is somehow held against movement, such as if the blind 11 suspended from the bifurcated end 28 of the holder 15 is abutting against one or more adjacent blinds 11 (out of concurrence with the other blinds), or some other obstruction. When this occurs, the resilient rachet elements 42 will ride over the internal teeth 44, thereby allowing the worm gear to cease turning, in a manner known to those skilled in the art, to allow the blind 11 to self align with the other blinds held in the head casing 12.

End wall 25 of housing 20 is substantially flat, with an integrally formed cord holding element 52 attached thereto by a substantially T-shaped integrally formed upper portion 54 from which the cord holding element 52 depends. The cord holding element 52 includes a resilient finger portion 56 which is normally biased against or close to the side wall 25 by the natural resiliency of the material from which it is made. When a carrier means 14 is in a vertical blind assembly of the present invention, the pull cord 13 is easily and quickly inserted into the cord holding element 52 by merely pressing the cord into the space 58 formed between the side wall 25 and resilient finger 56, against the bias of the finger 56, until the cord is pushed past the resilient finger and captured in a space 60 formed between the resilient finger and the T-shaped upper portion 54. The holding element 52 also includes a pair of holes 62 formed therethrough at the lower end thereof to allow each of the carriers to have the cord 13 fixed thereto, in a known manner, if the carrier is to be the end or lead carrier which pulls all of the blinds longitudinally along the track means 16 in the head casing 12, to the desired positions.

Each carrier means 14 also has a pair of followers or wheels 64 rotatably secured to projecting stub axles 66 at opposite ends of the housing 20. These wheels 64 fit in, and travel along the track means 16, to enable the carrier means 14 and depending blinds 11 to be moved longitudinally in the head casing 12 by the pull cord 13.

Carrier means 14 also include an upstanding annular opening 67 and a substantially T-shaped opening or slot 68 formed to the top wall 23 of housing 20 for selectively connecting and spacing each of the carrier means 14 together, in a manner known to those skilled in the art. The connecting and spacing means between each carrier means 14 may take any known or to be discovered form, such as a panograph arrangement 70 secured to each annular opening 67 by a pin means 72, or by a folding link means 74 (shown in broken line in FIG. 7) secured, in a known manner, in the T-shaped slots 68 of each carrier means.

It, therefore, can be seen that the blind assembly of the present invention includes unitary carrier assemblies or means 14 which are quickly and easily assembled in a head casing 12, by first inserting the rachet means and the worm gear and then inserting the blind holding means 15 in such a manner that the gear 27 at the top thereof is in engagement with the worm gear for limited rotation of a blind held in the holding means. The rotation of each blind will be concurrent with other blinds in the assembly, and will be limited in each direction, depending on the size of the blinds used, and were they contact each other on opening or closing the same. Furthermore, the internal rachet means in each worm gear in each carrier means allows the individual vertical blinds suspended from each to be self aligning with the other blinds, in a convenient and substantially trouble free manner. Finally, the carrier means will be moved, in spaced relationship from each other, by panograph or other connecting means, holding the carriers together.

Figure 4:
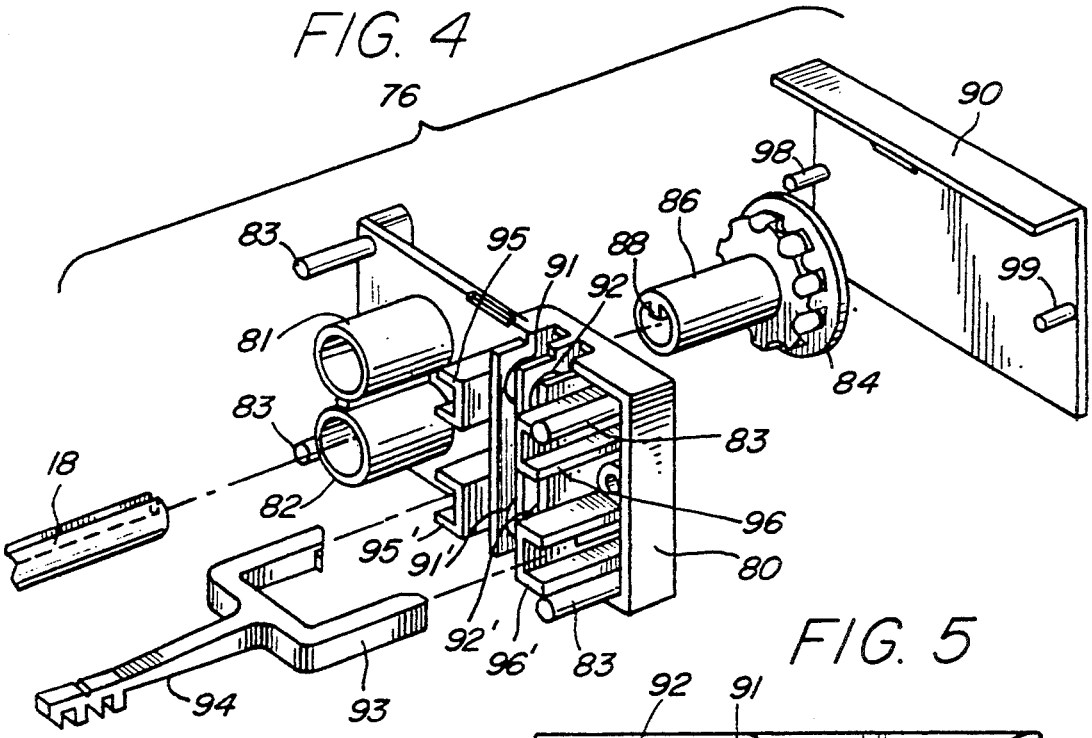
FIG. 4 is an exploded perspective view of one of the interchangeable and reversible end caps of the head casing of the present invention.
Figure 5:
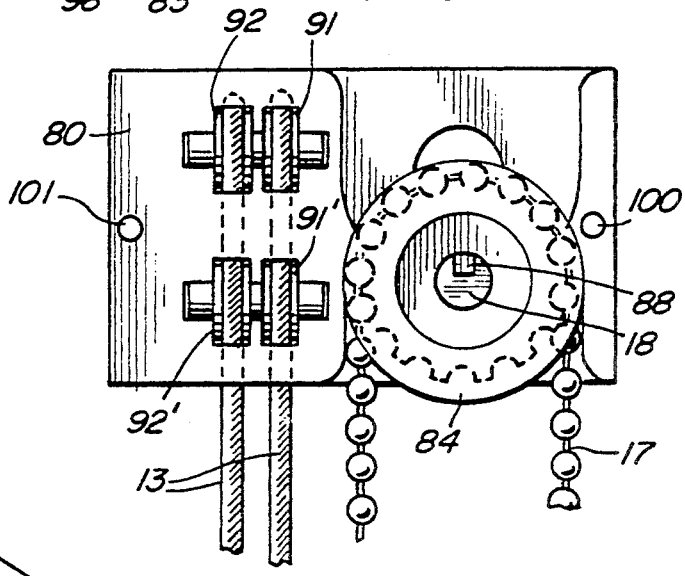
FIG. 5 is an end view of the end cap of FIG. 4, in the assembled position, with a pull cord and pull chain in position, and with the end cover removed.
Figure 6:
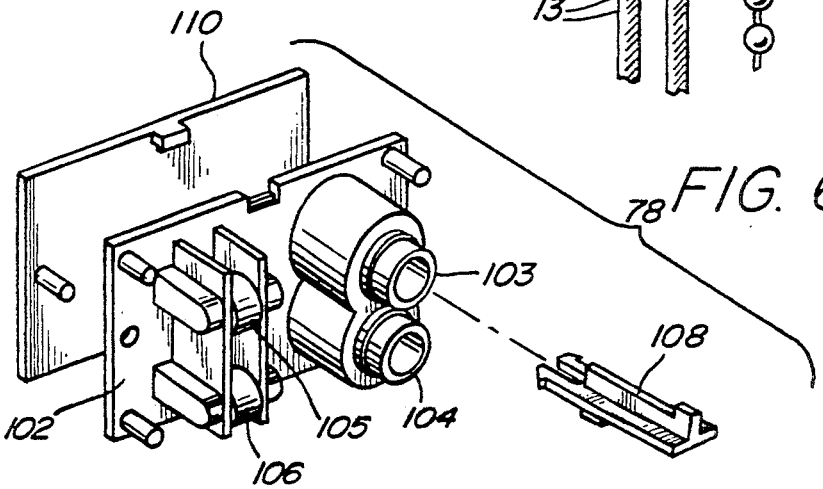
FIG. 6 is an exploded perspective view of the other interchangeable and reversible end cap of the head casing of the present invention.
Figure 7:
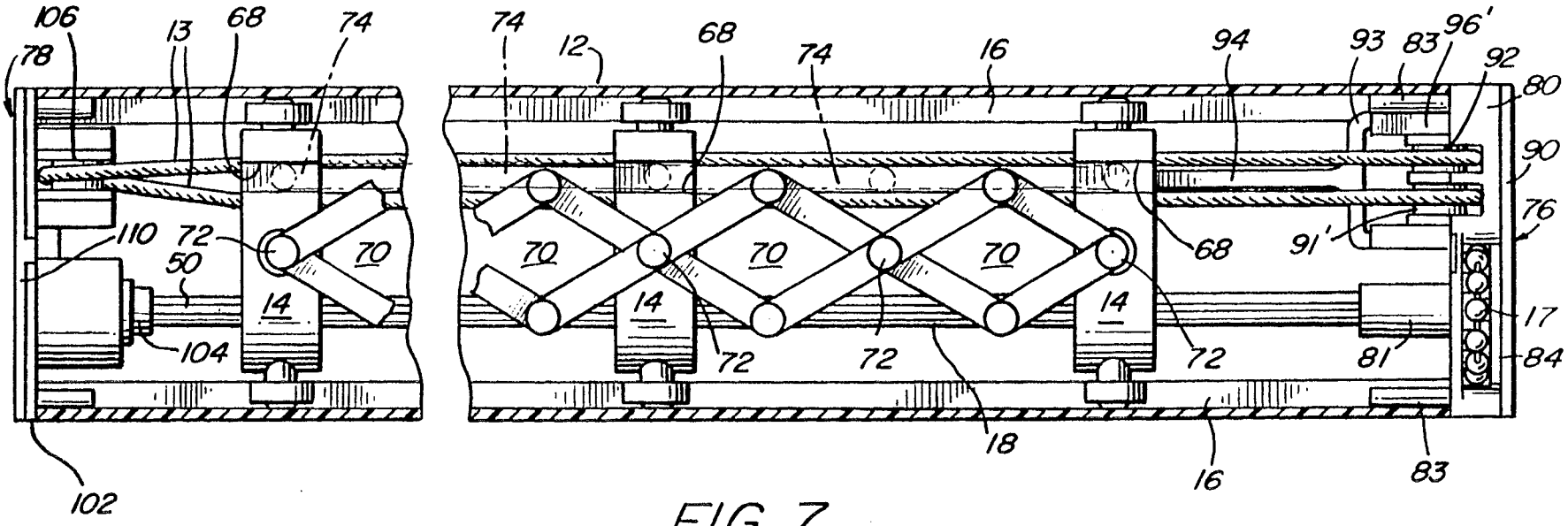
FIG. 7 is an enlarged partial top plan view of the head casing, partially in cross section, of the blind assembly of FIG. 1.

Turning now to FIGS. 4–7, there shown are unique, interchangeable and reversible end caps 76, 78 for securing to either end of the head casing 12, for use with the vertical blind assembly of the present invention. The end cap 76, shown most clearly in FIGS. 4 and 5, includes a frame 80 with a pair of tubular carrying means 81, 82, which interchangeably, rotatably support the positioning rod 18 and a pull chain pulley or wheel 84 having a tubular extension 86, insertable from opposite ends thereof. Depending on the position or orientation of the end cap when it is inserted into the head casing 12 and held therein, as by means of a plurality of corner posts 83, the positioning rod 18 will be inserted and held in a selected tubular carrying means 81 or 82. That is, as shown in FIGS. 4 and 5, the positioning rod is inserted into the lower tubular carrying means 82 from the inside end (the end to be inserted into the head casing), while the tubular extension 86 of wheel 84 is inserted from the outside or opposite end of this same tubular carrying means 82 (the end over which a cover 90 is secured). Tubular extension 86 is provided with an internal key 88, formed to the inside thereof, which internal key is held in the slot 50 of the positioning rod, so as to turn the positioning rod with the wheel 84 when the pull chain 17 is pulled in either direction. However, when the end cap 76 is turned 180 degrees, such as shown in FIG. 7, the positioning rod 18 will be inserted and held in the other tubular carrying means 81 from the inside end, while the tubular extension 86 of wheel 84 is inserted from the outside or opposite end of this same tubular carrying means 81.

The frame 80 also includes an upper and lower pair of pulley means 91, 92 and 91', 92', respectively, rotatably mounted therein, adjacent the tubular carrying means 81, 82, over which the pull cord 13 is threaded, for longitudinal operation of the carrier means 14 and their depending blinds 11 along the head casing. Furthermore, a stop means 94 is removably held in either of a pair of upper or lower holding flanges 95, 96 or 95', 96', by a forked end 93, i.e., the lower pair 95', 96', as shown in FIG. 4 (or upper pair 95, 96 as shown in FIG. 7), to prevent the carrier means 14 closest to the end cap 76 from abutting the end cap.

Finally, after the respective pulleys and wheel, as well as the pull chain and pull cord, are inserted in the proper positions, a cover 90 may be inserted thereon by any known means, such as by insertion of a pair of pins 98, 99 formed to the cover into a pair of holes 100, 101 formed in the frame 80. Furthermore, after the end cap 76 has been inserted into the head casing, the cover 90 may be removed to change or modify the elements held therein.

The other end cap 78, shown most clearly in FIG. 6, includes a frame 102 with extending tubular carrying means 103, 104, into which the position rod 18 is selectively inserted and supported for rotation, depending on the end of the head casing in which the end cap 78 is inserted and held by the corner pins thereof, and the orientation of the other end cap 76 and its respective parts. End cap 78 also includes pulleys 105, 106, on which the pull cord 13 will be selectively threaded (see FIG. 7), depending on the alignment of parts and the orientation of elements to be supported in the end caps 76 and 78. A further carrier stop means 108 is inserted and held in the tubular carrying means, such as 103, not supporting the positioning rod 18, to stop movement of the carriers 14 when the vertical blinds are drawn to the end cap 78. A cover 110 is also provided for removable placement over the frame 102.

It, thus, can be seen that the vertical blind assembly of the present invention includes interchangeable and reversible end caps which are inserted and held in the head casing 12 and cooperate with all of the elements of the vertical blind assembly so as to allow various types and sizes of blinds assemblies to be used. Additionally, the end caps allow the vertical blind assemblies to be easily modified or changed to accommodate various size openings, orientation of the head casing, or to repair or service such assemblies.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What I claim is:

1. A vertical blind system comprising a head casing having open ends and a track therein, a plurality of suspended vertical blinds held vertically by a plurality of carrier means movable along said track between said open ends of said head casing by operating means connected thereto, and each carrier means comprising an elongate, open sided, substantially rectangular housing having two ends and a substantially hollow interior with vertical blind holding means rotatably secured therein, said vertical blind holding means coacting with a worm gear rotatably mounted in each of said carrier means, adjacent to and in engagement with a gear formed on said vertical blind holding means, and wherein:

said open ends of said head casing are closed by interchangeable and reversible end caps;

said elongate, open sided, substantially rectangular housing of each of said carrier means includes a rachet means formed interiorly of an internal opening formed in said worm gear to allow said vertical blinds held in said vertical blind holding means to be self aligning;

each of said carrier means having a pull cord holding element formed integrally at one of the ends of said elongate, open sided, substantially rectangular housing; and said pull cord holding element having a resilient opening means formed therein for quick and easy insertion of said pull cord into said pull cord holding element from outside of said head casing through said resilient opening means.

2. The vertical blind system of claim 1 wherein said rachet means is comprised of a rachet carrier insertable into said internal opening formed in said worm gear, said rachet carrier having at least one rachet means thereon which cooperates with a plurality of detent means formed in said internal opening formed in said worm gear.

3. The vertical blind system of claim 2 wherein said worm gear and said rachet carrier are inserted into said elongate, open sided, substantially rectangular housing from opposite open sides thereof, and held together therein by snap fit means with said at least one rachet means and said plurality of detent means cooperating therein; said snap fit means including flanges formed on said worm gear and said rachet carrier fitting into and cooperating with partially annular areas formed internally of said elongate, open sided, substantially rectangular housing.

4. The vertical blind system of claim 2 wherein said internal opening formed in said worm gear is circular and said plurality of detent means extend entirely around said circular internal opening.

5. The vertical blind system of claim 1 wherein said resilient opening means in said holding element is a resilient finger formed to said holding element, and said resilient finger is biased toward an end wall at said one of the ends of said elongate, open sided, substantially rectangular housing so as to form an opening between said resilient finger and said end wall into which said pull cord may be inserted and held.

6. The vertical blind assembly of claim 1 wherein said interchangeable and reversible end caps comprise frames have tubular extensions formed thereto, into which said operating means comprised of a positioning rod for rotating said worm gears of each of said carrier means may be selectively inserted and rotatably held, and a plurality of pulleys rotatably mounted thereon adjacent said tubular extensions, into which said pull cord may be selectively threaded so as to move said carrier means from one end to the other along said track in said head casing.

7. The vertical blind assembly of claim 6, further including covers mounted to said interchangeable and reversible end caps and stop means selectively held in said interchangeable and reversible end caps to prevent said carrier means from abutting said interchangeable and reversible end caps when moved along said track in said head casing.

8. The vertical blind assembly of claim 7, further including linkage means secured to each of said carrier means for controlling movement of said carrier means relative to each other between the ends of said head casing.

9. The vertical blind assembly of claim 8 wherein said elongate, open sided, substantially rectangular housing of said carrier means includes an opening formed therein, adjacent said pull cord holding element, for securing a link means therein.

10. A vertical blind system comprising a head casing having open ends and a track therein, a plurality of suspended vertical blinds held vertically by a plurality of carrier means movable along said track between said open ends of said head casing by operating means connected thereto, and each carrier means comprising an elongate, open sided, substantially rectangular housing having two ends and a substantially hollow interior with vertical blind holding means rotatably secured therein, said vertical blind holding means coacting with a worm gear rotatably mounted in each of said carrier means, adjacent to and in engagement with a gear formed on said vertical blind holding means, and wherein:

said open ends of said head casing are closed by interchangeable and reversible end caps having frames with tubular extensions formed thereto, into which a positioning rod for rotating said worm gears of said carrier means is selectively inserted and rotatably held, and a plurality of pulleys rotatably mounted thereon adjacent said tubular extensions, into which a pull cord is selectively threaded so as to move said carrier means between said ends in said head casing; and covers mounted to said end caps, and stop means selectively held in said end caps to prevent said carrier means from abutting interchangeable and reversible said end caps;

said elongate, open sided, substantially rectangular housing of each of said carrier means includes a rachet means formed interiorly of an internal opening formed in said worm gear to allow said vertical blinds held in said vertical blind holding means to be self aligning, and a pull cord holding element formed integrally therewith; and said pull cord holding element having a resilient opening means formed therein for quick and easy insertion of said pull cord into said pull cord holding element from outside of said head casing through said resilient opening means.

11. The vertical blind system of claim 10 wherein said rachet means is comprised of a rachet carrier insertable into and held in said internal opening formed in said worm gear, said rachet carrier having at least one rachet means thereon which cooperates with a plurality of detent means formed in said internal opening of said worm gear.

12. The vertical blind system of claim 11 wherein said worm gear and said rachet carrier are inserted into said elongate, open sided, substantially rectangular housing from opposite open sides thereof, and held together therein with said at least one rachet means and said plurality of internal detents in engagement with each other; said worm gear and said rachet carrier including flanges formed thereon fitting into partially annular areas formed internally of said housing to thereby form a snap fit means which prevents removal of said worm gear and said rachet carrier from said elongate, open sided, substantially rectangular housing.

13. The vertical blind system of claim 11 wherein said internal opening in said worm gear is circular and said plurality of internal detents extend entirely around said circular opening.

14. The vertical blind system of claim 10 wherein said resilient opening in said pull cord holding element includes a resilient finger formed in said pull cord holding element, and said resilient finger is biased toward an end wall at said one of the ends of said elongate, open sided, substantially rectangular housing so as to form an opening between said resilient finger and said end wall into which said pull cord may be inserted and held.

15. The vertical blind assembly of claim 14, further including linkage means secured to each of said carrier means for controlling movement of said carrier means relative to each other between the ends of said head casing.

16. The vertical blind assembly of claim 15 wherein said elongate, open sided, substantially rectangular housing of said carrier means includes an opening formed therein, adjacent said pull cord holding element, for securing a link means therein.

17. A vertical blind system comprising a head casing having open ends and a track therein, a plurality of suspended vertical blinds held vertically by a plurality of carrier means movable along said track between said open ends of said head casing by operating means connected thereto, and each carrier means comprising an elongate, open sided, substantially rectangular housing having two ends and a substantially hollow interior with vertical blind holding means rotatably secured therein, said vertical blind holding means coacting with a worm gear rotatably mounted in each of said carrier means, adjacent to and in engagement with a gear formed on said vertical blind holding means, and wherein:

said open ends of said head casing are closed by interchangeable and reversible end caps;

said elongate, open sided, substantially rectangular housing of each of said carrier means includes a rachet means formed in an internal opening in said worm gear; said rachet means being comprised of a rachet carrier insertable into said internal opening of said worm gear, said rachet carrier having at least one rachet means thereon which cooperates with a plurality of detent means formed in said internal opening of said worm gear, and said internal opening of said worm gear being circular with said plurality of internal detents extending entirely around the circular opening, to allow said vertical blinds to be self aligning;

a pull cord holding element formed integrally with said elongate, open sided, substantially rectangular housing of each of said carrier means at one of the ends thereof;

said worm gear and said rachet carrier being inserted into said substantially rectangular housing of each of said carrier means from opposite open sides thereof, and held together therein by snap fit means with said at least one rachet means and said plurality of internal detents cooperating therein; said snap fit means including flanges formed on said worm gear and said rachet carrier fitting into and cooperating with partially annular areas formed internally of elongate, open sided, said housing; and said pull cord holding element having a resilient opening means formed therein for quick and easy insertion of said pull cord into said pull cord holding element from outside of said head casing; and said resilient opening including a resilient finger formed therein; said resilient finger being biased toward an end wall at one of the ends of said elongate, open sided, substantially rectangular housing so as to form an opening between said resilient finger and said end wall into which said pull cord may be inserted and held.

18. The vertical blind assembly of claim 17 wherein said interchangeable and reversible end caps include frames having covers mounted thereto and stop means selectively held in said covers to prevent said carrier means from abutting said interchangeable and reversible end caps; said frames of said interchangeable and reversible end caps also having tubular extensions formed thereto, into which said operating means comprised of a positioning rod for rotating said worm gears of said carrier means is selectively inserted and rotatably held, and a plurality of pulleys rotatably mounted on said interchangeable and reversible end caps, adjacent said tubular extensions, into which said pull cord is selectively threaded so as to move said carrier means from one end cap to the other end cap in said head casing.

19. The vertical blind assembly of claim 18, further including linkage means secured to each of said carrier means for controlling movement of said carrier means relative to each other between the ends of said head casing.

20. The vertical blind assembly of claim 19 wherein said elongate, open sided, substantially rectangular housing of said carrier means includes an opening formed therein, adjacent said pull cord holding element, for securing a linkage means therein.

* * * * *